US007830255B2

(12) United States Patent
Leone

(10) Patent No.: US 7,830,255 B2
(45) Date of Patent: Nov. 9, 2010

(54) ELECTRONIC ARTICLE SURVEILLANCE ACTIVATOR/DEACTIVATOR AND METHOD THEREFOR

(75) Inventor: Steven V. Leone, Lake Worth, FL (US)

(73) Assignee: Sensormatic Electronics, LLC, Boca Raton, FL (US)

( * ) Notice: Subject to any disclaimer, the term of this patent is extended or adjusted under 35 U.S.C. 154(b) by 297 days.

(21) Appl. No.: 12/225,595

(22) PCT Filed: Apr. 5, 2006

(86) PCT No.: PCT/US2006/012482

§ 371 (c)(1),
(2), (4) Date: Sep. 25, 2008

(87) PCT Pub. No.: WO2007/114819

PCT Pub. Date: Oct. 11, 2007

(65) Prior Publication Data

US 2009/0261977 A1 Oct. 22, 2009

(51) Int. Cl.
*G08B 13/14* (2006.01)

(52) U.S. Cl. ..... 340/568.1; 340/572.3; 335/284

(58) Field of Classification Search ..... 340/568.1, 340/572.3, 572.6; 235/462.45; 335/284
See application file for complete search history.

(56) References Cited

U.S. PATENT DOCUMENTS

| | | | | |
|---|---|---|---|---|
| 5,594,420 | A * | 1/1997 | Copeland et al. | 340/572.3 |
| 5,917,412 | A * | 6/1999 | Martin | 340/572.3 |
| 6,057,763 | A * | 5/2000 | Brace et al. | 335/284 |
| 6,967,578 | B1 * | 11/2005 | Guida | 340/572.3 |
| 7,068,172 | B2 * | 6/2006 | Yang et al. | 340/572.3 |
| 2009/0212952 | A1 * | 8/2009 | Yang | 340/572.3 |

* cited by examiner

*Primary Examiner*—John A Tweel, Jr.

(57) ABSTRACT

An electric motor, system and method for activating and deactivating an EAS article is disclosed. The electric motor has a stationary electromagnet having a center. The electric motor further has a platform located parallel to the electromagnet, wherein the platform rotates about a center concentric with the center of the electromagnet. The electric motor further has a first magnet with a first polarity located on the platform and a second magnet with a second polarity located on the platform radially opposite to the first magnet. The electric motor further has a commutator for periodically reversing current supplied to the electromagnet so as to produce a first magnetic field that interacts with the first and the second magnet and causes the platform to spin about its center. When the platform rotates, a second magnetic field for one of activation and deactivation of an EAS article is produced by the first and the second magnet.

20 Claims, 7 Drawing Sheets

ELECTRONIC ARTICLE SURVEILLANCE ACTIVATOR/DEACTIVATOR AND METHOD THEREFOR

TECHNICAL FIELD

The present invention relates to electronic article surveillance (EAS) technology and in particular to a motor for deactivating and activating EAS articles.

BACKGROUND INFORMATION

Electronic article surveillance (or EAS) is a technological method for managing and protecting assets such as by preventing shoplifting from retail stores, warehouses, etc. or pilferage of books from libraries. Special tags or articles are fixed to merchandise or books. These tags are removed or deactivated by a clerk or librarian when the item is properly bought or checked out. At the exits of the store or library, a detection system sounds an alarm or otherwise alerts the staff when it senses active tags.

Conventional deactivators use a capacitive discharge system requiring a large high-voltage capacitor and a large coil antenna, which translates into a large, bulky and heavy deactivator. The weight, cost and volume of such a deactivation solution limits the portability and usability the device. Further, the large energy requirement of the device eliminates the possibility of powering the unit with a battery or other small power source. As such, conventional deactivators that are battery operated require large heavy batteries, thereby further increasing the size and weight of the device.

Another type of conventional deactivator uses a magnetic field produced by a pair of permanent magnets that are spun around by an electric motor (such as a DC motor) to deactivate the EAS tag or article. Since the DC motor itself is powered using a magnetic field, this arrangement requires the use of two separate and independent magnetic fields that must be maintained. This increases the complexity and the number of parts of the system as well as the size and power requirements.

Thus, a need has arisen to overcome the problems with the prior art and more particularly for a more efficient, lightweight and user-friendly deactivator for EAS tags or articles.

SUMMARY OF THE INVENTION

The present invention addresses the deficiencies of the art in respect to activators/deactivators of EAS tags. The present invention also provides a way to activate, deactivate and detect EAS tags using a miniaturized, battery-powered apparatus.

According to one aspect, the present invention provides an electric motor for activating and deactivating an EAS article. The electric motor has a stationary electromagnet having a center. The electric motor further has a platform located parallel to the electromagnet, wherein the platform rotates about a center concentric with the center of the electromagnet. The electric motor further has a first magnet with a first polarity located on the platform and a second magnet with a second polarity located on the platform radially opposite to the first magnet. The electric motor further has a commutator for periodically reversing current supplied to the electromagnet so as to produce a first magnetic field that interacts with the first and the second magnet and causes the platform to spin about its center. When the platform rotates, a second magnetic field for activating and deactivating an EAS article is produced by the first and the second magnet.

According to another aspect, the present invention provides a method for activating and deactivating an EAS article by producing a first magnetic field by a stationary electromagnet having a center, wherein the first magnetic field interacts with a first magnet having a first polarity and a second magnet having a second polarity. The method further includes periodically reversing current supplied to the electromagnet so as to periodically reverse the first magnetic field and causing a platform located parallel to the electromagnet to rotate about a center concentric with the center of the electromagnet, wherein the first magnet and the second magnet are located on the platform radially opposite to each other. The method further includes producing a second magnetic field for activating and deactivating an EAS article, wherein the second magnetic field is produced by the first and the second magnet when the platform rotates.

In accordance with still another aspect, the present invention provides a system for managing EAS articles. The system includes a detector of EAS articles comprising a conductive coil and an activator/deactivator of EAS articles. The activator/deactivator includes a stationary electromagnet having a center and a platform located parallel to the electromagnet, wherein the platform rotates about a center concentric with the center of the electromagnet. The system further includes a first magnet with a first polarity located on the platform and a second magnet with a second polarity located on the platform radially opposite to the first magnet. The system further includes a commutator for periodically reversing current supplied to the electromagnet so as to produce a first magnetic field that interacts with the first and the second magnet and causes the platform to spin about its center. When the platform rotates, a second magnetic field for activating and deactivating an EAS article is produced by the first and the second magnet.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION

Figure 2:
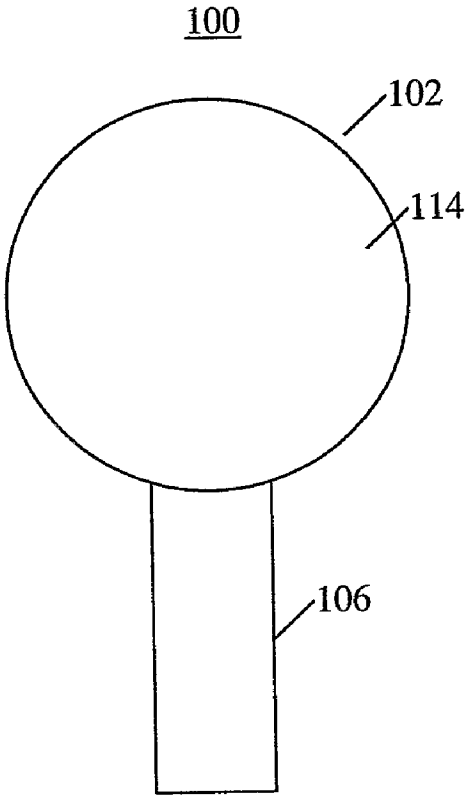
FIG. 2 is an illustration of a frontal view of the activator/deactivator of FIG. 1.

The present invention advantageously provides an EAS tag activation/deactivation unit that is miniaturized as compared with known units and can be used with battery power. The present invention utilizes the magnets used to drive an electric motor to also produce the magnetic field that is used to activate/deactivate an EAS tag. This is beneficial as it reduces the number of magnets used in an EAS tag activation/deactivation unit and simplifies the system. In one alternative, the EAS tag activation/deactivation unit can be integrated with an EAS tag detector and/or a bar code scanner, so as to integrate a number of asset management functions in one device. In another alternative, the EAS tag activation/deactivation unit can be integrated into a desk, counter, table top scanner, checkout lane, bag well or other point-of-sale location, or simply used as a handheld device by a clerk or other employee. Further, multiple EAS tag activation/deactivation units can be arranged in a grid for a larger aperture deactivation field.

As explained above, EAS articles or tags are fixed to merchandise or books and are activated and/or deactivated by clerks or librarians. There are various types of EAS tags available, including magnetic tags, acousto-magnetic tags and radio frequency tags. Magnetic tags are made of a strip of amorphous metal (such as metglas) which has a very low magnetic saturation value. Except for permanent tags, this strip is also lined with a strip of ferromagnetic material with a moderate coercive field. Detection of this type of EAS tag is achieved by sensing harmonics and sum or difference signals generated by the non-linear magnetic response of the material under a mixture of low-frequency (in the 10 Hz to 1000 Hz range) magnetic fields. When the ferromagnetic material is magnetized, it biases the amorphous metal strip into saturation, where it no longer produces harmonics. Deactivation of these tags is therefore done with magnetization using a strong magnet, while activation requires demagnetization.

Acousto magnetic tags are similar to magnetic tags in that they are made of two strips, a strip of amorphous metal and a strip of ferromagnetic material. They differ in that these strips are not bound together but free to oscillate mechanically. Also, the tag is active when the material is magnetized. Detection of this type of EAS tag typically requires the use of a 58 kHz (or 66 kHz) magnetic field which induces mechanical resonance by magnetostriction. When the excitation field is turned off, these tags continue to oscillate mechanically, which produces a magnetic signal because of the magnetized second strip. Deactivation of magneto-acoustic tags requires demagnetization.

Radio-frequency tags are essentially an LC tank circuit that has a resonance peak at 8.2 MHz or 2 MHz. Detection of this type of EAS tag is achieved by sweeping around the resonant frequency and detecting a dip. Deactivation is achieved by detuning the circuit by partially destroying the capacitor. This is done by submitting the EAS tag to a strong electromagnetic field which will induce voltages exceeding the capacitor's breakdown voltage.

Figure 1:
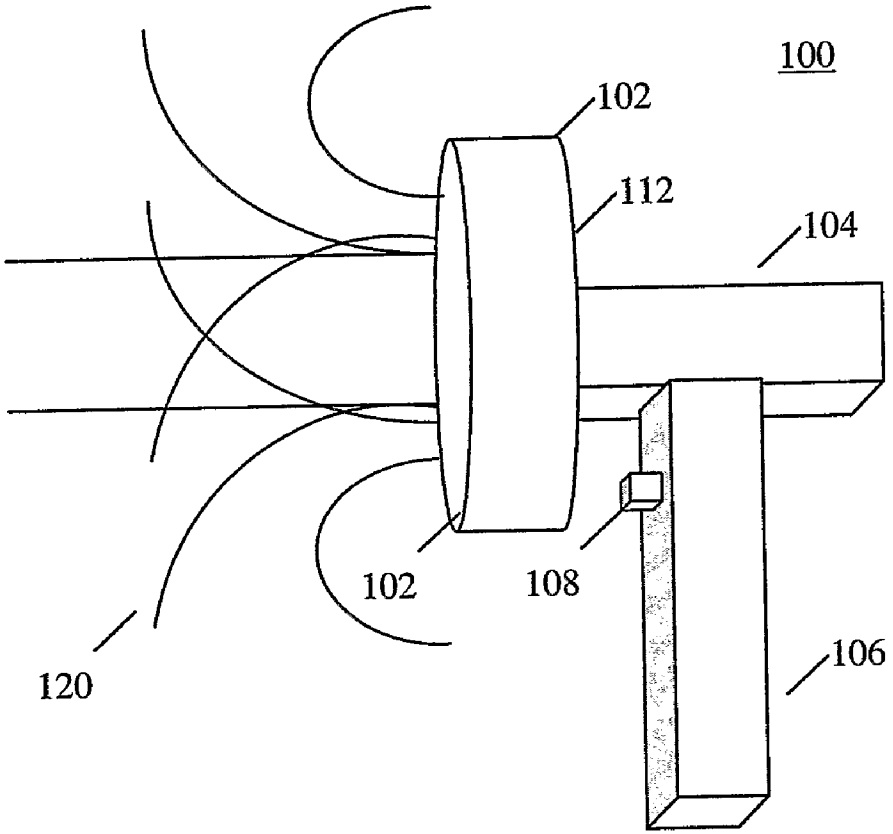
FIG. 1 is an illustration of a side view of a miniaturized mobile EAS tag activator/deactivator constructed in accordance with the principles of the present invention.

Referring now to the drawing figures in which like reference designators refer to like elements there is shown in FIG. 1 an illustration of a side view of a miniaturized mobile EAS tag activator/deactivator 100 constructed in accordance with the principles of the present invention. FIG. 1 shows a cylindrical shaped disc 102 used to perform the activation/deactivation processes of the present invention, described in greater detail below. In one embodiment of the present invention, the diameter of the disc is about three inches. The front portion 114 of the disc 102 emanates a magnetic field, shown by magnetic field lines 120, that is used to activate and/or deactivate EAS tags. The magnetic field lines 120 can be substantially toroidal shaped and are produced by the processes described below.

In one embodiment of the present invention, the disc 102 also includes an EAS tag detector for detecting the presence of an EAS tag, thereby initiating the activation and/or deactivation process of the activator/deactivator 100. This allows the activator/deactivator 100 to preserve power and limit operation to those instances when an EAS tag is detected, as opposed to operating on a constant basis. In another embodiment of the present invention, the disc 102 also includes a bar code scanner for scanning a bar code or other information on a label or tag affixed to an item. This allows the user of the activator/deactivator 100 to perform all necessary functions—EAS tag detection, EAS tag activation/deactivation and bar code scanning—using only one device, i.e., the activator/deactivator 100.

FIG. 1 also shows a central module 104 for housing various parts of the activator/deactivator 100, such as the power source or computing functions described in greater detail below. In an embodiment of the present invention, activator/deactivator 100 is battery powered wherein the battery, whether a standard disposable battery or a rechargeable battery, is housed in the central module 104. In another embodiment of the present invention, activator/deactivator 100 is powered via a power cord connected to a wired power source, wherein the power cord is coupled to the central module 104.

The central module 104 is coupled to the back portion 112 of the disc 102 and to a top portion of a handle 106. The handle 106 can be used to grip the activator/deactivator 100 by a user, such as a clerk or librarian, and a button 108 on the handle 106 can be used to execute certain functions of the activator/deactivator 100, such as EAS tag detection, EAS tag activation/deactivation or bar code scanning. In an embodiment of the present invention, activator/deactivator 100 is powered via a power cord coupled to the handle 106. The battery can also be housed inside the handle 106. FIG. 2 is an illustration of a frontal view of the activator/deactivator 100, showing the handle 106 and the front portion 114 of the disc 102.

Figure 3:
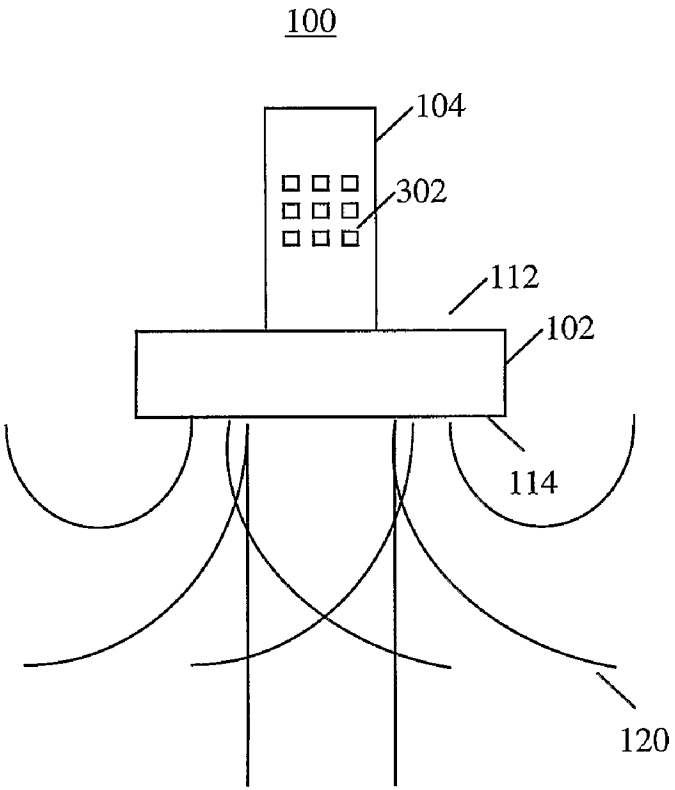
FIG. 3 is an illustration of a top view of the activator/deactivator of FIG. 1.

FIG. 3 is an illustration of a top view of the activator/deactivator 100, showing the central module 104 connected to the back portion 112 of the disc 102. The front portion 114 of the disc 102 emanates a magnetic field, shown by magnetic field lines 120. Also shown is a key pad 302, which can be a button pad or sensor pad for entering numerical information or data of any type. Key pad 302 may also include a display for displaying alphanumeric information. The key pad 302 and display may be used by a user of the activator/deactivator 100 to key in or read information during one of the functions of the activator/deactivator 100, such as EAS tag detection, EAS tag activation/deactivation or bar code scanning. For example, if the bar code scanner cannot read a label, the user may enter the SKU or other identifier for the item being scanned.

Figure 4:
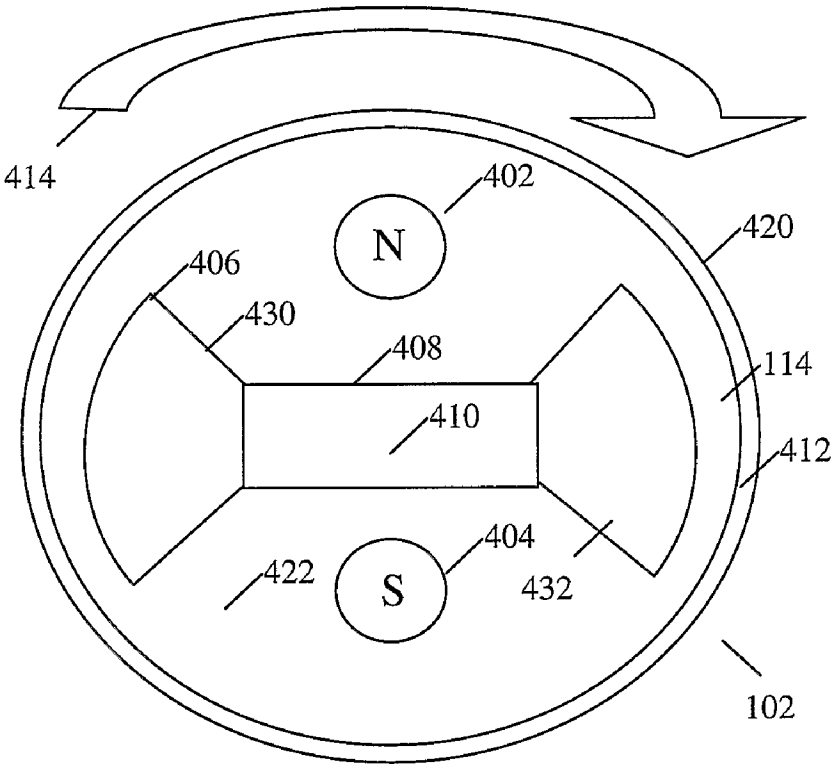
FIG. 4 is an illustration of an exploded frontal view of the disc module of the activator/deactivator of FIG. 1.

FIG. 4 is an illustration of an exploded frontal view of the disc module 102 of the activator/deactivator 100. The exploded frontal view of disc 102 shows the components housed by a housing 420 of the disc 102 from the direction of the front portion 114 of the disc 102. Included in the disc 102 is a stator 406 having a center 410 and extending lengthwise from a first side 430 of the stator 406 to the opposite side 432 of the stator 406. The stator 406 is stationary and includes a conductive coil 408 or winding through which a current is passed, thereby turning the stator 406 into an electromagnet wherein opposite ends of the stator 406 hold opposing polarities of the electromagnet. Located behind the conductive coil 408 (not shown) is commutator, which is an electrical switch that periodically reverses the current in the conductive coil 408, thereby periodically reversing polarity of the electromagnet of the stator 406.

FIG. 4 also shows a platform 422 consisting of a planar element disposed in the plane of FIG. 4 and located behind and parallel to the stator 406. The platform 422 is rotatably coupled to the disc 102 at a center that is concentric with the center 410 of the stator 406. Located on opposing sides of the platform 422 are a first magnet 402 and a second magnet 404. The first and the second magnets 402, 404 can be a permanent magnet or an electromagnet. The first and second magnets 402, 404 are of opposite polarities.

The elements within housing 420 constitute a type of electric motor wherein when the conductive coil 408 is powered, a magnetic field is generated around the stator 406. The first side 430 of the stator 406 is pushed away from the second magnet 404 and drawn toward the first magnet 402. Also, the opposite side 432 is pushed away from the first magnet 402 and drawn toward the second magnet 404. Since the stator 406 is stationary but the platform 422 (to which the magnets 402, 404 are coupled) has an axis of rotation at center 410, the platform 422 is caused to rotate in the clockwise direction. When the magnets 402, 404 become horizontally aligned with the stator 406, the commutator reverses the direction of current through the conductive coil 408, reversing the magnetic field. When this occurs, each magnet is attracted to the other end of the stator 406 and rotation continues in the clockwise direction. This process then repeats twice a turn or every one hundred eighty degrees of the rotation of the platform 422. Arrow 414 shows the clockwise direction of rotation of the platform 422. In one embodiment of the present invention, the commutator is replaced by an H-bridge circuit which periodically reverses the direction of current through the conductive coil 408.

The rotation of the magnets 402, 404 on the platform 422 cause the creation of a magnetic field shown by the magnetic filed lines 120 in FIG. 1. This field is used to activate or deactivate an EAS tag by moving an EAS tag toward the front portion 114 of the disc 102 and then moving the EAS tag away. An alternating and decaying magnetic field is experienced by the EAS tag which results in deactivation. Activation of the EAS tag can also be executed using a similar procedure wherein the EAS tag is placed near one of the poles of the stator 406 and then moved away. A non-alternating magnetic field is experienced by the EAS tag which results in activation.

FIG. 4 also shows a conductive coil 412 that acts as an EAS tag detector. The conductive coil 412 is sensitive to the presence of a magnetic EAS tag as the movement of a magnet near such a coil produces an electromotive force that may be detected by a sensor (not shown) that is coupled with the conductive coil 412. The detection of an EAS tag using the conductive coil 412 can be used to initiate or power up other functions, such as the rotation of the platform 422 or a bar code scanner. In another embodiment of the present invention, the central module 104 also includes a digital signal processor for detecting the presence of an EAS tag, a wireless EAS synchronizer, control logic and an EAS transmitter for detection in conjunction with the conducting coil 412.

Figure 5:
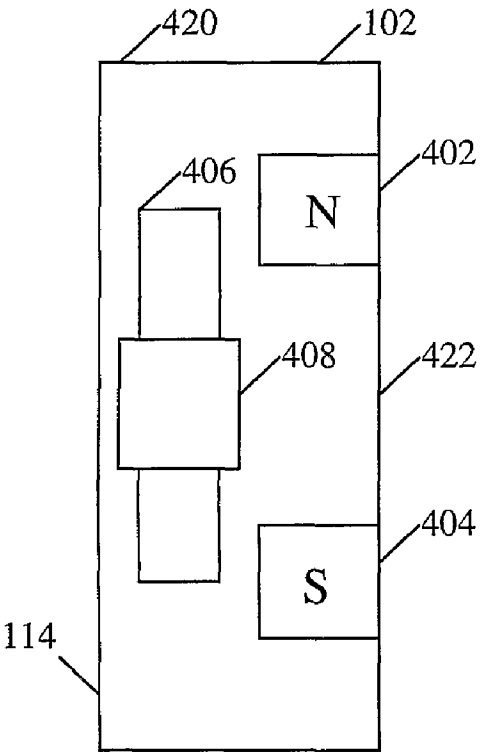
FIG. 5 is an illustration of an exploded side view of the disc module of the activator/deactivator of FIG. 1.

FIG. 5 is an illustration of an exploded side view of the disc module 102 of the activator/deactivator 100. FIG. 5 shows the housing 420 including the platform 422 to which the first magnet 402 and the second magnet 404 are affixed. Also shown is the stator 406 and conductive coil 408, which, when activated, causes the platform 422 to spin, thereby producing a magnetic field that emanates from the front portion 114 of the disc 102.

In one embodiment of the present invention, the space between each magnet 402, 404 is set to a predefined distance so as to avoid metal objects from attaching to the magnets. In another embodiment of the present invention, a shorting bar (not shown) is included inside the housing 420 such that when the magnets 402, 404 stop spinning after activation, they are aligned with the shorting bar so as to discharge them and remove magnetization, thereby further preventing metal objects from attaching to the magnets.

Figure 6:
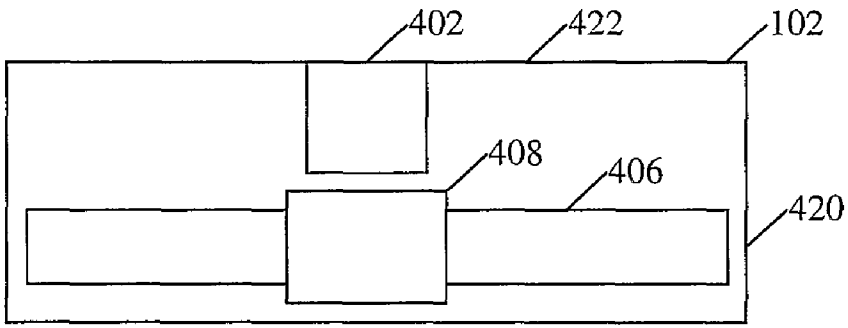
FIG. 6 is an illustration of an exploded top view of the disc module of the activator/deactivator of FIG. 1.

FIG. 6 is an illustration of an exploded top view of the disc module 102 of the activator/deactivator 100. FIG. 6 also shows the housing 420 including the platform 422 to which the first magnet 402 is affixed (the second magnet 404 is not shown as the view of the second magnet 404 is obstructed by the first magnet 402). Also shown is the stator 406 and conductive coil 408, which when activated, produces a magnetic field that emanates from the front portion 114 of the disc 102.

Figure 7:
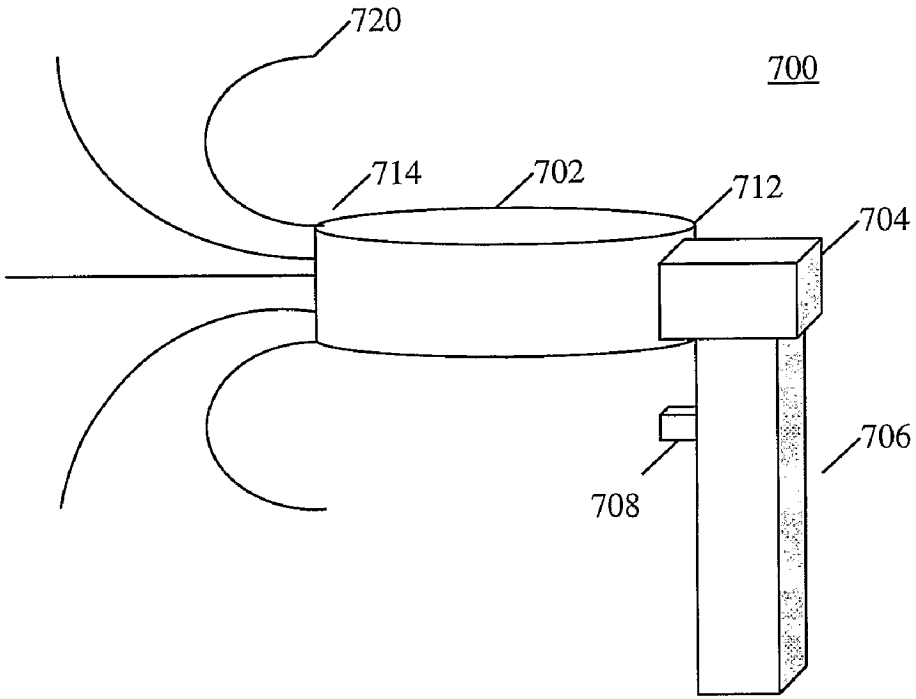
FIG. 7 is an illustration of a side view of an alternate embodiment of a miniaturized mobile EAS tag activator/deactivator in accordance with the principles of the present invention.

FIG. 7 is an illustration of a side view of an alternate embodiment of a miniaturized mobile EAS tag activator/deactivator 700 in accordance with the principles of the present invention. FIG. 7 shows a cylindrical shaped disc 702 similar to the disc 102 of FIG. 1 except the diameter of the disc 702 is transverse to the handle instead of parallel to the handle like disc 102. The front portion 714 of the disc 702 emanates a magnetic field, shown by magnetic field lines 720, that is used to activate and/or deactivate EAS tags.

Figure 8:
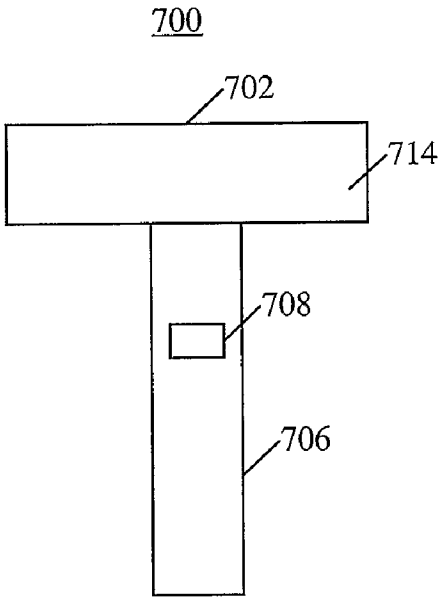
FIG. 8 is an illustration of a frontal view of the activator/deactivator of FIG. 7.

FIG. 7 also shows a central module 704 for housing various parts of the activator/deactivator 700, such as the power source or computing functions described in greater detail below. The central module 704 is coupled to the back portion 712 of the disc 702 and to a top portion of a handle 706. The handle 706 can be used to grip the activator/deactivator 700 by a user and a button 708 on the handle 706 can be used to execute certain functions of the activator/deactivator 700, such as EAS tag detection, EAS tag activation/deactivation or point-of-sale bar code scanning. FIG. 8 is an illustration of a frontal view of the activator/deactivator 700 of FIG. 7, showing the handle 706 (including button 708) and the front portion 714 of the disc 702.

Figure 9:
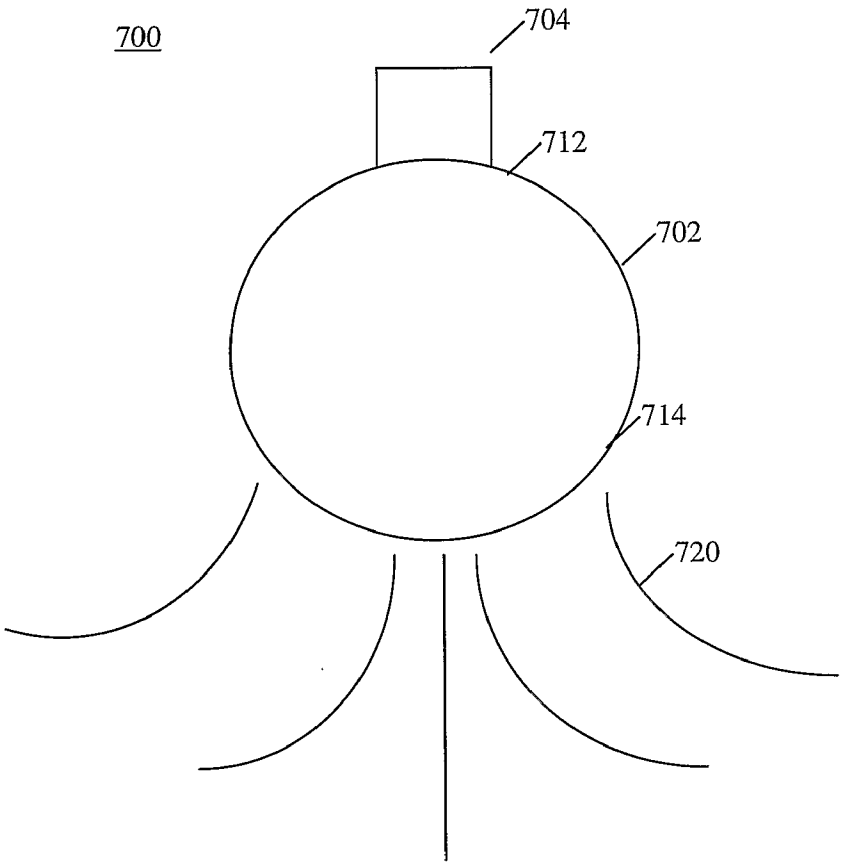
FIG. 9 is an illustration of a top view of the activator/deactivator of FIG. 7.

FIG. 9 is an illustration of a top view of the activator/deactivator 700, showing the central module 704 connected to the back portion 712 of the disc 702. The front portion 714 of the disc 702 emanates a magnetic field, shown by magnetic field lines 720.

Figure 10:
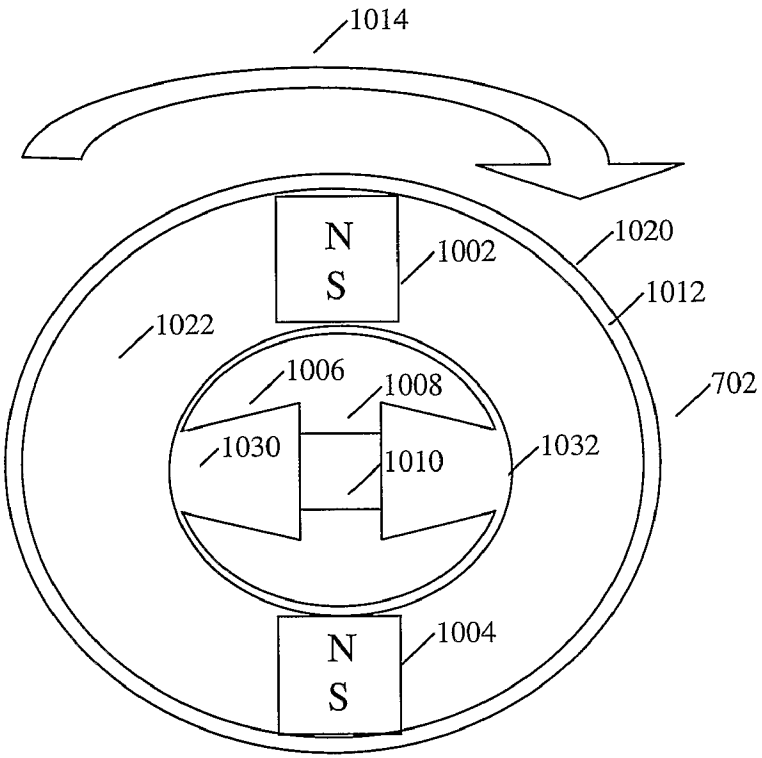
FIG. 10 is an illustration of an exploded top view of the disc module of the activator/deactivator of FIG. 7.

FIG. 10 is an illustration of an exploded top view of the disc module of the activator/deactivator 700. The exploded top view of disc 702 shows the components housed by a housing 1020 of the disc 702 from the direction of the top of the disc 702. Included in the disc 702 is a stator 1006 having a center 1010 and extending lengthwise from the left side 1030 of the stator 1006 to the right side 1032 of the stator 1006. The stator 1006 is stationary and includes a conductive coil 1008 or winding through which a current is passed, thereby turning the stator 1006 into an electromagnet wherein opposite ends of the stator 1006 would hold opposing polarities of the electromagnet. Located behind the conductive coil 1008 (not shown) is a commutator, which is an electrical switch that periodically reverses the current in the conductive coil 1008, thereby periodically reversing polarity of the electromagnet of the stator 1006.

FIG. 10 also shows a platform 1022 having a planar element disposed in the plane of FIG. 10 and located behind and parallel to the stator 1006. The platform 1022 is rotatably coupled to the disc 702 at a center that is concentric with the center 1010 of the stator 1006. Located on opposing sides of the platform 1022 is a first magnet 1002 and a second magnet 1004. The first and the second magnets 1002, 1004 can be a permanent magnet or an electromagnet. The first and second magnets 1002, 1004 are of opposite polarity.

The elements within housing 1020 constitute a type of electric motor wherein when the conductive coil 1008 is powered, a magnetic field is generated around the stator 1006. The first side 1030 of the stator 1006 is pushed away from the second magnet 1004 and drawn toward the first magnet 1002. Also, the opposite side 1032 is pushed away from the first magnet 1002 and drawn toward the second magnet 1004. Since the stator 1006 is stationary but the platform 1022 (to which the magnets 1002, 1004 are coupled) has an axis of rotation at center 1010, the platform 1022 is caused to rotate in the clockwise direction. When the magnets 1002, 1004 become horizontally aligned with the stator 1006, the commutator reverses the direction of current through the conductive coil 1008, reversing the magnetic field. When this occurs, each magnet is 5 attracted to the other end of the stator 1006 and rotation continues in the clockwise direction, This process then repeats twice a turn or every one hundred eighty degrees of the rotation of the platform 1022. Arrow 1014 shows the clockwise direction of rotation of the platform 1022.

The rotation of the magnets 1002, 1004 on the platform 1022 cause the creation of a magnetic field shown by the magnetic field lines 720 in FIG. 7. This field is used to activate or deactivate an EAS tag by moving an EAS tag toward the front portion 714 of the disc 702 and then moving the EAS tag away. An alternating and decaying magnetic field is experienced by the EAS tag which results in deactivation. Activation of the EAS tag can also be executed using a similar procedure wherein the EAS tag is placed near one of the poles of the stator 1006 and then moved away. A non-alternating magnetic field is experienced by the EAS tag which results in activation.

FIG. 10 also shows a conductive coil 1012 that acts as an EAS tag detector. The conductive coil 1012 is sensitive to the presence of a magnetic EAS tag as the movement of a magnet near such a coil produces an electromotive force that may be detected by a sensor (not shown) that is coupled with the conductive coil 1012. The detection of an EAS tag using the conductive coil 1012 can be used to initiate or power up other functions, such as the rotation of the platform 1022 or a bar code scanner.

Figure 12:
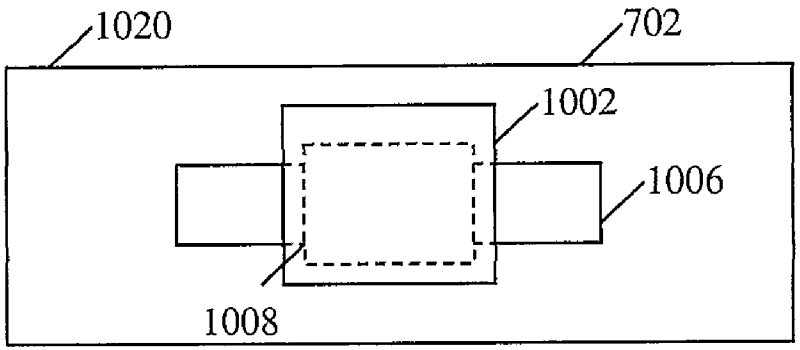
FIG. 12 is an illustration of an exploded frontal view of the disc module of the activator/deactivator of FIG. 7.
Figure 11:
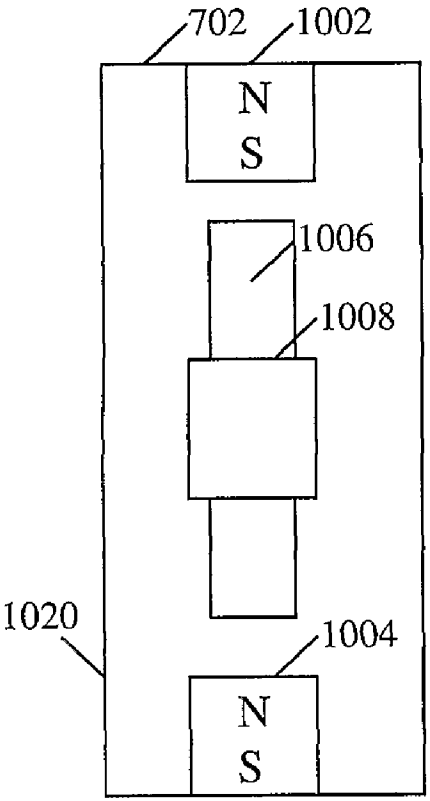
FIG. 11 is an illustration of an exploded side view of the disc module of the activator/deactivator of FIG. 7.

FIG. 11 is an illustration of an exploded side view of the disc module of the activator/deactivator 700. FIG. 11 shows the housing 1020 and the first magnet 1002 and the second magnet 1004. Also shown is the stator 1006 and conductive coil 1008, which, when activated, produces a magnetic field that emanates from the disc 702. FIG. 12 is an illustration of an exploded frontal view of the disc module of the activator/deactivator 700. FIG. 12 also shows the housing 1020 including the first magnet 1002 (the second magnet 1004 is not shown as its view is obstructed by the first magnet 1002). Also shown is the stator 1006 and conductive coil 1008 (partially obstructed), which, when activated, produces a magnetic field that emanates from the disc 702.

Figure 13:
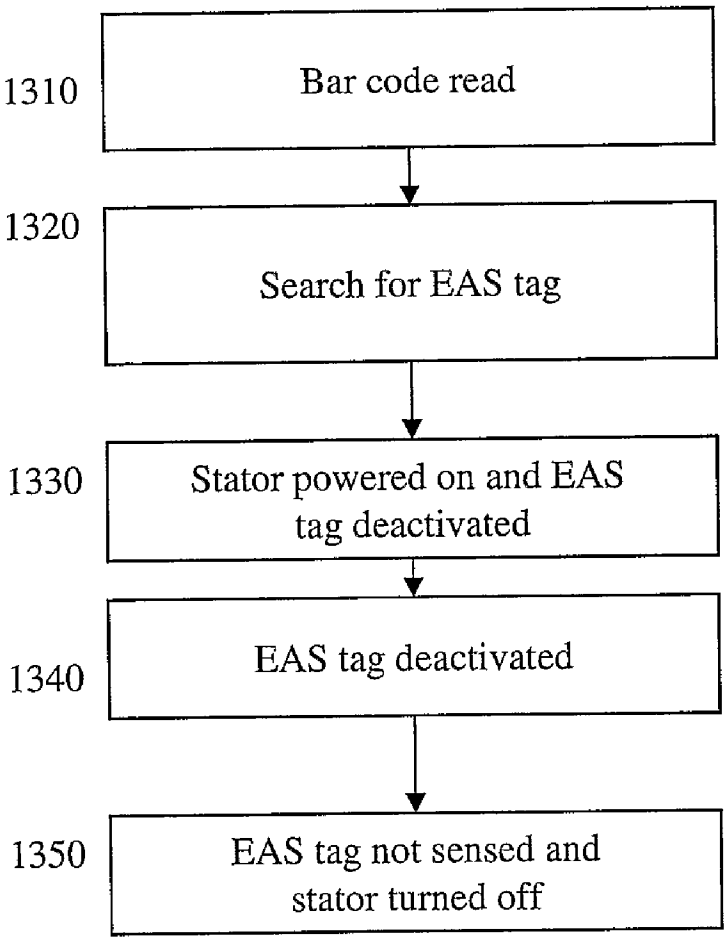
FIG. 13 is a flow chart showing a point-of-sale process of an EAS tag activator/deactivator of the present invention.

FIG. 13 is a flow chart showing an exemplary point-of-sale process of an EAS tag activator/deactivator, such as activator/deactivator 100, of the present invention. In block 1310, a user that is, for example, conducting a sale of an item having a bar code label reads the label with a bar code scanner integrated into the activator/deactivator 100. This spawns a search for the EAS tag of the item by the conducting coil 412 in block 1320. Once the EAS tag is found by the conducting coil 412, in block 1330 the stator 406 is activated with a current, which causes the spinning of the platform 422 and the production of the magnetic field shown by field lines 120. In block 1340 the EAS tag is deactivated by the magnetic field. In block 1350, the conducting coil 412 no longer detects the EAS tag and the stator 406 is deactivated, which causes the spinning of the platform 422 to stop.

In either of the embodiments described above, a speed sensor having a magnetic pick-up can be used to sense the rotational speed of the magnets, thereby providing a signal that can be used by the digital signal processor (or any other microprocessor/microcontroller) to control the rotational speed. Also, the case where a short bar, described above, is used, the digital signal processor (or any other microprocessor/microcontroller) can control the stopping point of the magnets 402 and 404 so that they align with the shorting bar.

The present invention can be realized in hardware, software, or a combination of hardware and software. Any kind of computing system, or other apparatus, adapted for carrying out the methods described herein, is suited to perform the functions described herein A typical combination of hardware and software could be a specialized or general purpose computer system having one or more processing elements and other hardware elements described herein along with a computer program stored on a storage medium that, when loaded and executed, controls the computer system such that it carries out the methods described herein. The present invention can also be embedded in a computer program product, which comprises all the features enabling the implementation of the methods described herein, and which, when loaded in a computing system is able to carry out these methods. Storage medium refers to any volatile or non-volatile storage device.

Computer program or application in the present context means any expression, in any language, code or notation, of a set of instructions intended to cause a system having an information processing capability to perform a particular function either directly or after either or both of the following a) conversion to another language, code or notation; b) reproduction in a different material form. In addition, unless mention was made above to the contrary, it should be noted that all of the accompanying drawings are not to scale. Significantly, this invention can be embodied in other specific forms without departing from the spirit or essential attributes thereof, and accordingly, reference should be had to the following claims, rather than to the foregoing specification, as indicating the scope of the invention.

What is claimed is:

1. An electric motor for activating and deactivating an EAS article, the electric motor comprising:

a stationary electromagnet having a center;

a platform located parallel to the electromagnet, wherein the platform rotates about a center concentric with the center of the electromagnet;

a first magnet having a first polarity, the first magnet being positioned on the platform;

a second magnet having a second polarity, the second magnet being positioned on the platform radially opposite to the first magnet; and a commutator for periodically reversing current supplied to the electromagnet so as to produce a first magnetic field that interacts with the first and the second magnet and causes the platform to spin about its center, wherein when the platform rotates, a second magnetic field for one of activation and deactivation of the EAS article is produced by the first and the second magnet.

2. The electric motor of claim 1, wherein the stationary electromagnet comprises:

a stator including a pole having a center; and a conductor wound multiple times around the stator.

3. The electric motor of claim 2, wherein the platform extends radially from its center and has substantially the same radius as the pole of the stator.

4. The electric motor of claim 3, wherein the first magnet is located on the platform a first distance from its center wherein the first distance is substantially equal to a radius of the pole of the stator.

5. The electric motor of claim 4, wherein the second magnet is located on the platform radially opposite to the first magnet.

6. The electric motor of claim 5, further comprising:

a housing for containing the electromagnet, platform, first magnet, second magnet and commutator.

7. The electric motor of claim 2, wherein the first magnet and the second magnet are any one of an electromagnet and a permanent magnet.

8. The electric motor of claim 2, wherein the EAS article comprises any one of a magnetic tag and an acousto-magnetic tag.

9. A method for activating and deactivating an EAS article, comprising:

producing a first magnetic field by a stationary electromagnet having a center, wherein the first magnetic field interacts with a first magnet having a first polarity and a second magnet having a second polarity;

periodically reversing current supplied to the electromagnet so as to periodically reverse the first magnetic field;

causing a platform located parallel to the electromagnet to rotate about a center concentric with the center of the electromagnet, wherein the first magnet and the second magnet are positioned on the platform radially opposite each other; and producing a second magnetic field for one of activating and deactivating an EAS article, wherein the second magnetic field is produced by the first and the second magnet when the platform rotates.

10. The method of claim 9, wherein producing a first magnetic field further comprises:

supplying current to a conductor wound multiple times around a stator.

11. The method of claim 10, wherein periodically reversing further comprises:

periodically reversing current supplied to the electromagnet using a commutator, so as to periodically reverse the first magnetic field.

12. The method of claim 11, wherein the producing a second magnetic field further comprises:

producing a second magnetic field for deactivating an EAS article, wherein the second magnetic field is produced by the first magnet and the second magnet, which comprise one of an electromagnet and a permanent magnet.

13. The method of claim 12, wherein the producing a second magnetic field further comprises:

producing a second magnetic field for activating and deactivating an EAS article comprising any one of a magnetic tag and an acousto-magnetic tag.

14. The method of claim 9, further comprising:

moving an EAS article towards the platform for one of activation and deactivation of the EAS article by interacting with the second magnetic field.

15. A system for managing EAS articles, comprising:

An EAS article detector, the detector comprising a conductive coil; and an activator/deactivator of EAS articles, comprising:

a stationary electromagnet having a center;

a platform located parallel to the electromagnet, wherein the platform rotates about a center concentric with the center of the electromagnet;

a first magnet with a first polarity located on the platform;

a second magnet with a second polarity located on the platform radially opposite to the first magnet; and a commutator for periodically reversing current supplied to the electromagnet so as to produce a first magnetic field that interacts with the first and the second magnet and causes the platform to spin about its center, wherein when the platform rotates, a second magnetic field for activating and deactivating an EAS article is produced by the first and the second magnet.

16. The system of claim 15, wherein the stationary electromagnet comprises:

a stator including a pole having a center; and a conductor wound multiple times around the stator.

17. The system of claim 15, further comprising:

a housing in which the detector and the activator/deactivator are located.

18. The system of claim 15, wherein the first magnet and the second magnet are one of an electromagnet and a permanent magnet.

19. The system of claim 15, wherein an EAS article comprises any one of a magnetic tag and an acousto-magnetic tag.

20. The system of claim 15, wherein the system is located at a point of sale station in a retail store.

* * * * *